US006397871B1

(12) United States Patent
Cheng

(10) Patent No.: US 6,397,871 B1
(45) Date of Patent: Jun. 4, 2002

(54) ADJUSTABLE SUNSHADE ASSEMBLY

(76) Inventor: Yuan-Te Cheng, No.12-12, Lai Chien Liao, Chia Li Town, Tainan Hsien (TW)

( * ) Notice: Subject to any disclaimer, the term of this patent is extended or adjusted under 35 U.S.C. 154(b) by 0 days.

(21) Appl. No.: 09/688,826

(22) Filed: Oct. 17, 2000

(51) Int. Cl.[7] ..... E04H 15/58

(52) U.S. Cl. ..... 135/117; 135/96; 135/98; 135/21

(58) Field of Search ..... 135/96, 98, 117, 135/21

(56) References Cited

U.S. PATENT DOCUMENTS 116,157 A * 6/1871 Child ..... 135/98 X
706,722 A * 8/1902 Burland ..... 135/90
1,581,180 A * 4/1926 Csajaghy et al. ..... 135/150
2,547,896 A * 4/1951 Wellen ..... 135/16 X
2,926,678 A * 3/1960 Francis ..... 135/90
4,284,095 A * 8/1981 Norton ..... 135/21
4,449,542 A * 5/1984 McSwain ..... 135/98
5,735,302 A * 4/1998 Saliva ..... 135/20.1
6,145,141 A * 11/2000 Whittington et al. ..... 135/90 X
6,220,261 B1 * 4/2001 Glatz ..... 135/20.3

* cited by examiner

*Primary Examiner*—Carl D. Friedman
*Assistant Examiner*—Brian E. Glessner
(74) *Attorney, Agent, or Firm*—Rosenberg, Klein & Lee

(57) ABSTRACT

A sunshade assembly has a main frame having a canopy, a plurality of ribs, a shaft, a runner, and a plurality of stretchers. The main frame is connected to a wall or stand by a connecting device. The connecting device includes a seat secured to the wall or stand, and a connecting tube having a first end pivotally connected to the seat. The connecting tube is adjustable in an overall length thereof. The connecting tube further has a second end for engaging with an upper end of the shaft of the main frame.

6 Claims, 10 Drawing Sheets

ADJUSTABLE SUNSHADE ASSEMBLY

BACKGROUND OF THE INVENTION

1. Field of the Invention

The present invention relates to an adjustable sunshade assembly with improved illumination and support as well as space-utilizing efficiency. In addition, the adjustable sunshade assembly can be adjusted in the position according to need.

2. Description of the Related Art

Sunshades are often used on beaches, stands, outdoor cafés, etc. FIG. 9 of the drawings illustrates a conventional sunshade 1' comprising a canopy 11', a plurality of ribs 12', a shaft 13', a runner 14', and a plurality of stretchers 15'. When mounted to, e.g., a table 2' for an outdoor café, the shaft 13' is extended through a central hole 21' of the table 2', and bulbs (not shown) may be mounted around the sunshade 1' to provide illumination when necessary. The runner 14' is slidable along the shaft 13' for opening or closing the sunshade 1'. As illustrated in FIG. 10, a stand 3' may be attached to a lower end of the shaft 13' for outdoor use.

The conventional sunshade is found to have the following disadvantages:

1. The shaft 13' reduces available space below the canopy 11'. Namely, the space and view are both limited by the shaft 13'.
2. Adjustment in the position of the sunshade 1' in response to the incident sunlight is difficult to proceed with.
3. Additional illumination devices and wires are required for illumination in the night, resulting in aesthetically unpleasing effect.
4. The shaft 13' tends to break or bend when strong wing blows the canopy 13'.

SUMMARY OF THE INVENTION

A sunshade assembly in accordance with the present invention comprises:

a main frame comprising a canopy, a plurality of ribs, a shaft, a runner, and a plurality of stretchers; and a connecting means for securely attaching the main frame to a support, the connecting means comprising:

a seat secured to the support, and a connecting tube having a first end pivotally connected to the seat, the connecting tube being adjustable in an overall length thereof, the connecting tube further having a second end for engaging with an upper end of the shaft of the main frame.

More than one of the ribs each has a ring mounted to a lower end thereof. A plurality of chains are provided and each has an upper end connected to the second end of the connecting tube and a lower end connected to the ring on an associated rib.

The seat is U-shape having an upper side, an intermediate side, and a lower side. The intermediate side of the seat is secured to the support. The upper side and the lower side of the seat having aligned pivot holes for pivotally receiving the first end of the connecting tube.

The second end of the connecting tube is a vertical tube section having an upper end to which the upper ends of the chains are attached. The vertical tube section further has a lower end for engaging with the upper end of the shaft. The lower end of the vertical tube section includes a hole, and the upper end of the shaft includes an engaging portion extended into the hole of the vertical tube section.

A bulb mounted in a lower end of the shaft. Wires for the bulb are inserted into the shaft.

The support is a wall or a stand. The stand is adjustable in an overall height thereof. In addition, the stand is capable of supporting more than one sunshade assembly.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
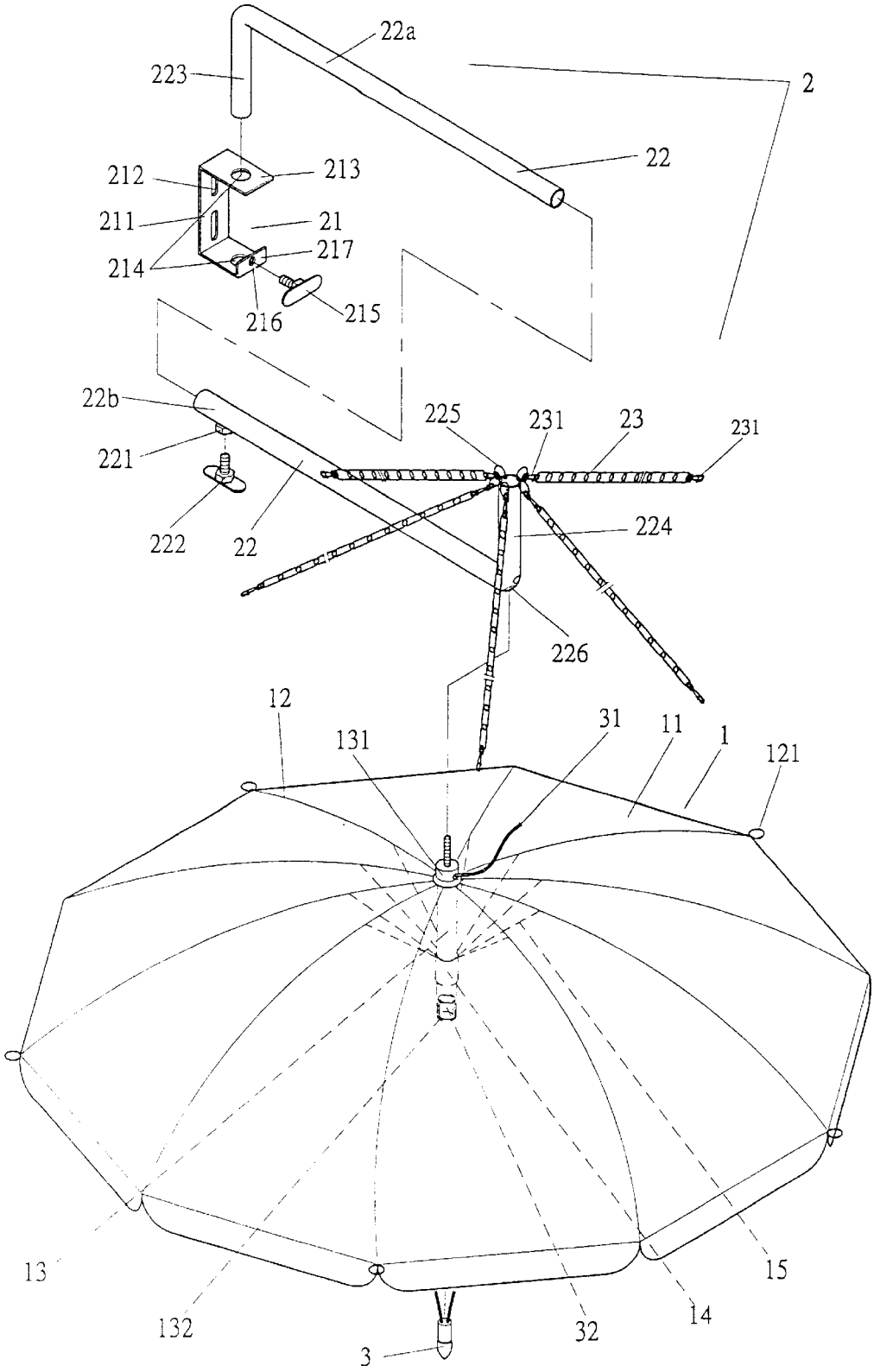
FIG. 1 is an exploded perspective view of an embodiment of an adjustable sunshade assembly in accordance with the present invention.
Figure 2:
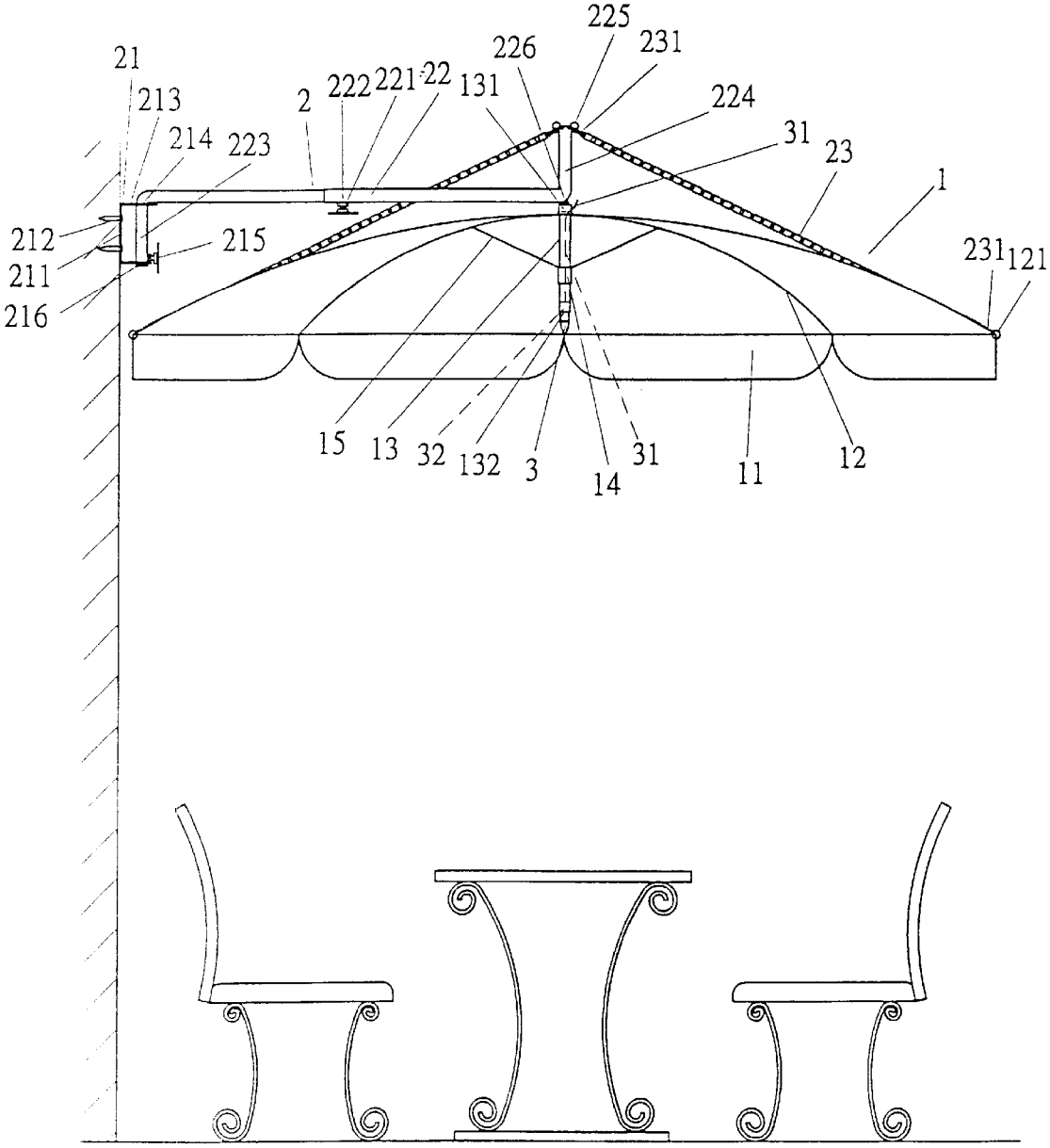
FIG. 2 is a schematic side view illustrating use of the adjustable sunshade assembly in FIG. 1.
Figure 5:
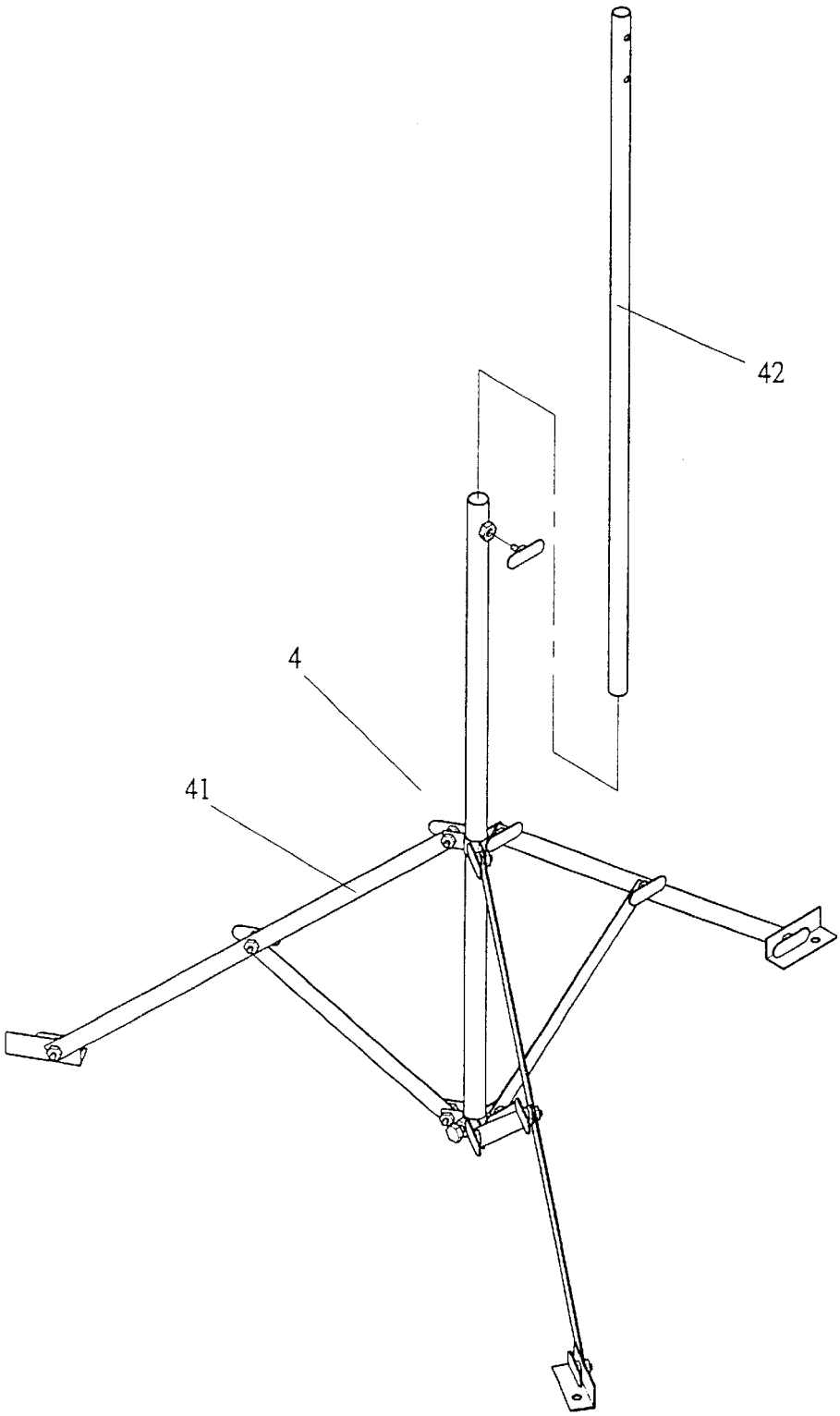
FIG. 5 is an exploded perspective view of a stand to which the adjustable sunshade assembly in accordance with the present invention is mountable.

Referring to FIGS. 1 and 2, a sunshade assembly in accordance with the present invention generally includes a main frame 11 and means 2 for connecting the main frame 11 to a support, such as a wall (FIG. 2) or a stand (FIG. 5). The main frame 11 includes a canopy 11, a plurality of ribs 12, a shaft 13, a runner 14, and a plurality of stretchers 15. Some of the ribs 12 each include a ring 121 at a distal end thereof for engaging with an end of an associated chain 23, which will be described later.

The shaft 13 is hollow and includes an appropriate length so as not to protrude beyond the canopy too far. In addition, an engaging portion 131 is formed on an upper end of the shaft 13 and a bulb-engaging portion 132 on a lower end thereof for engaging with a bulb 3. Wires 31 are provided for electrical connection with the bulb 3.

The connecting means 2 includes a seat 21 and a connecting tube 22. The seat 21 is substantially U-shape and includes an intermediate side 211 having engaging holes 212 so as to be attached to a wall (FIG. 2) or a stand 4 (FIG. 5). The seat 21 further includes aligned pivot holes 214 in upper and lower sides 213 thereof. An extension 217 extends upward from a distal end of the lower side 213 and includes a hole 216 through which a tightening knob 215 extends.

The connecting tube 22 may include a plurality of tube sections allowing adjustment in an overall length thereof. In this embodiment, the connecting tube 22 includes two tube sections 22*a* and 22*b,* wherein the tube section 22*a* includes a downwardly extending vertical section 223 pivotally received in the pivot holes 214 and a horizontal section (not labeled). The other tube section 22*b* includes a horizontal section (not labeled) releasably engaged the horizontal section of the tube section 22*a* and an upwardly extending section (vertical section) 224. A plurality of rings 225 are mounted on an upper end of the vertical section 224, and an engaging hole 226 is defined in a lower end of the vertical section 224 for engaging with the engaging portion 131 of the shaft 13. The overall length of the connecting tube 22 is adjustable by a tightening knob 222 that extends through a hole 221 in an end of the horizontal section of the tube section 22*b*.

There are five chains 23 provided in this embodiment and each includes an upper end with a connecting ring 231 for connection with an associated ring 225 and a lower end with a connecting ring 231 for connection with the ring 121 on an associated rib 12.

In use, referring to FIG. 2, the seat 21 is fixed to the wall, the vertical section 223 of the connecting tube 22 is extended through the pivot holes 214 of the seat 21 and retained in place by the tightening knob 215. The wires 31 for the bulb 3 are inserted into the shaft 13, and the bulb 3 is mounted to the bulb-engaging portion 132 on the lower end of the shaft 13. A lamp seat 32 may be mounted in the bulb-engaging portion 132. After assembly, as can be seen from FIG. 2, a larger space and an aesthetically pleasing effect are available to the users.

Figure 3:
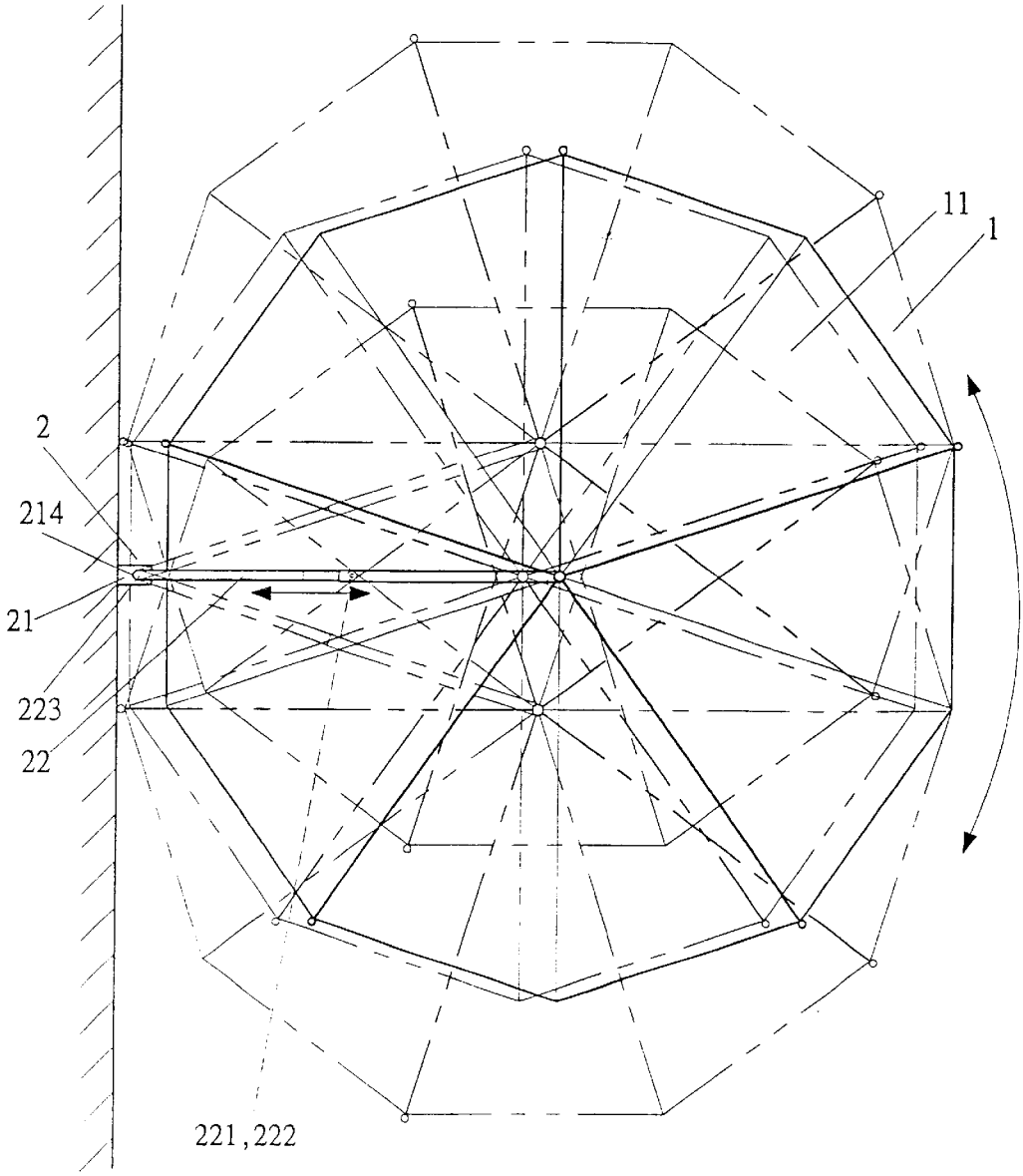
FIG. 3 is a top view illustrating adjustment in the position of the adjustable sunshade assembly in FIG. 2.

Referring to FIGS. 2 and 3, when adjusting position of the canopy 11, the tightening knob 215 is loosened and the connecting tube 22 is turned to a desired angular position relative to the seat 21. Then, the tightening knob 215 is tightened. In addition, the tightening knob 222 can be loosened to adjust the overall length of the connecting tube 22. Thus, position of the canopy 11 can be adjusted in response to the orientation of the incident sunlight. After the lower connecting rings 231 of the chains 23 are disengaged from the rings 121 on the ribs 12, the canopy 11 can be collapsed by moving the runner 14.

Figure 4:
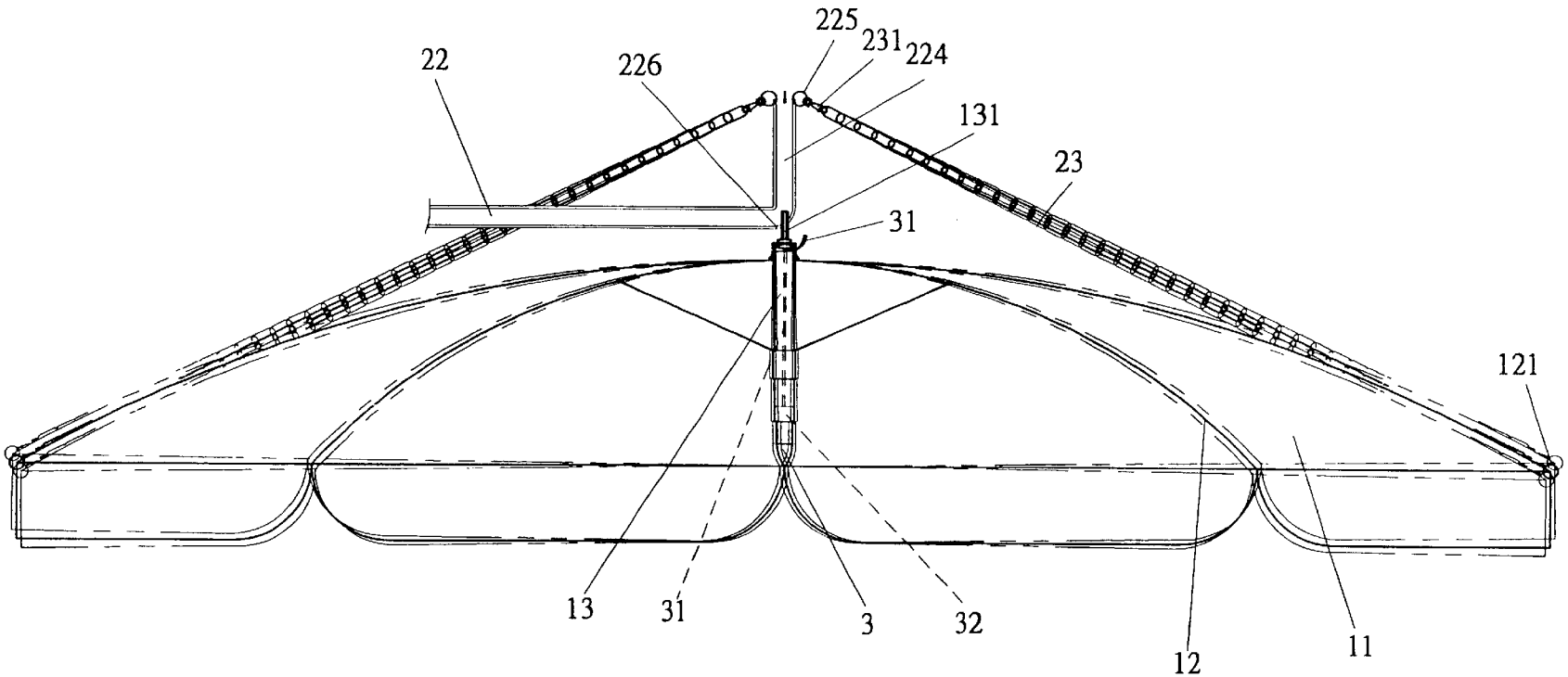
FIG. 4 is a sectional view of the adjustable sunshade assembly in FIG. 1.

Referring to FIG. 4, since the canopy 11 is evenly supported by the flexible chains 23 and the engaging portion 131 of the shaft 13 is not fixedly engaged with the connecting tube 22, the canopy 11 can be reliably supported by the chains 23 even if the canopy 11 is shifted due to strong wing. Namely, the canopy 11 may resist strong wing.

Figure 6:
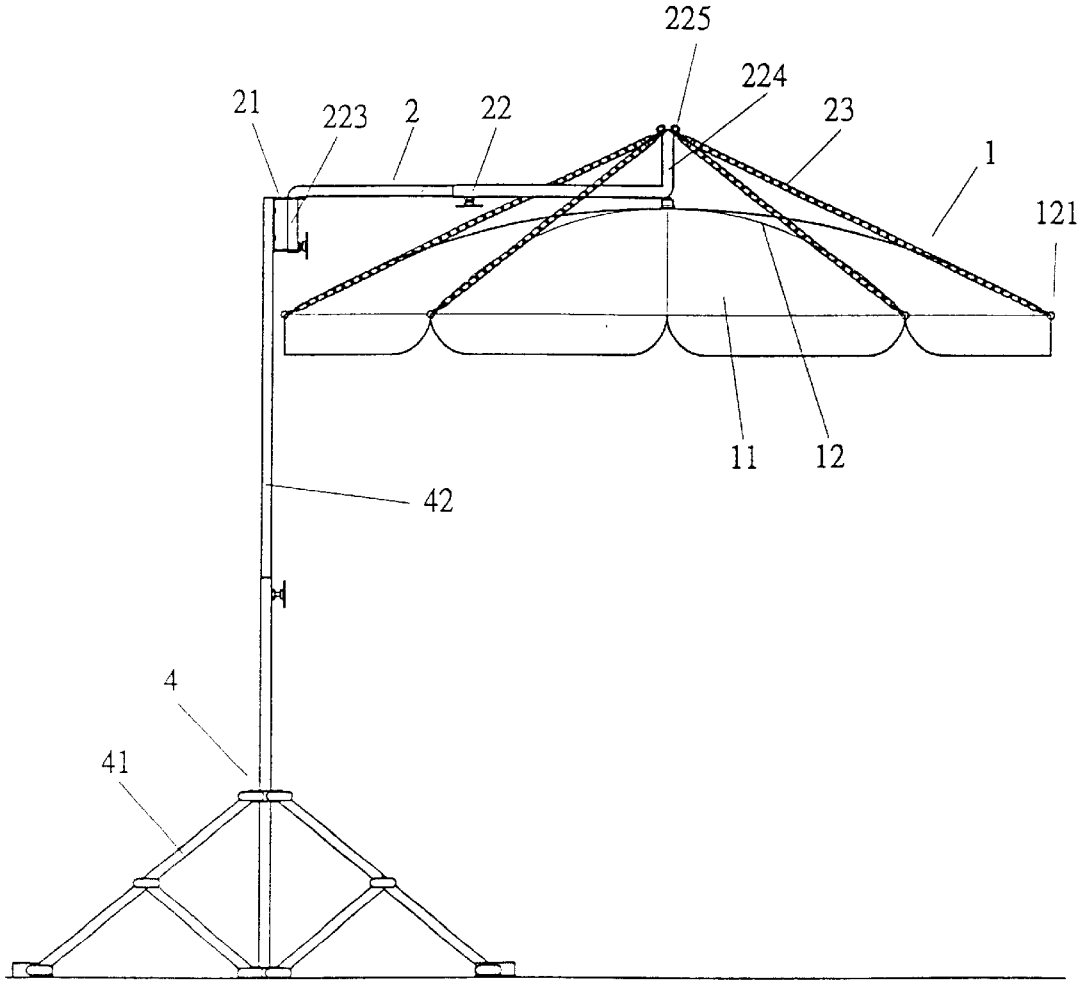
FIG. 6 is a schematic side view illustrating the adjustable sunshade assembly supported by the stand in FIG. 5.
Figure 7:
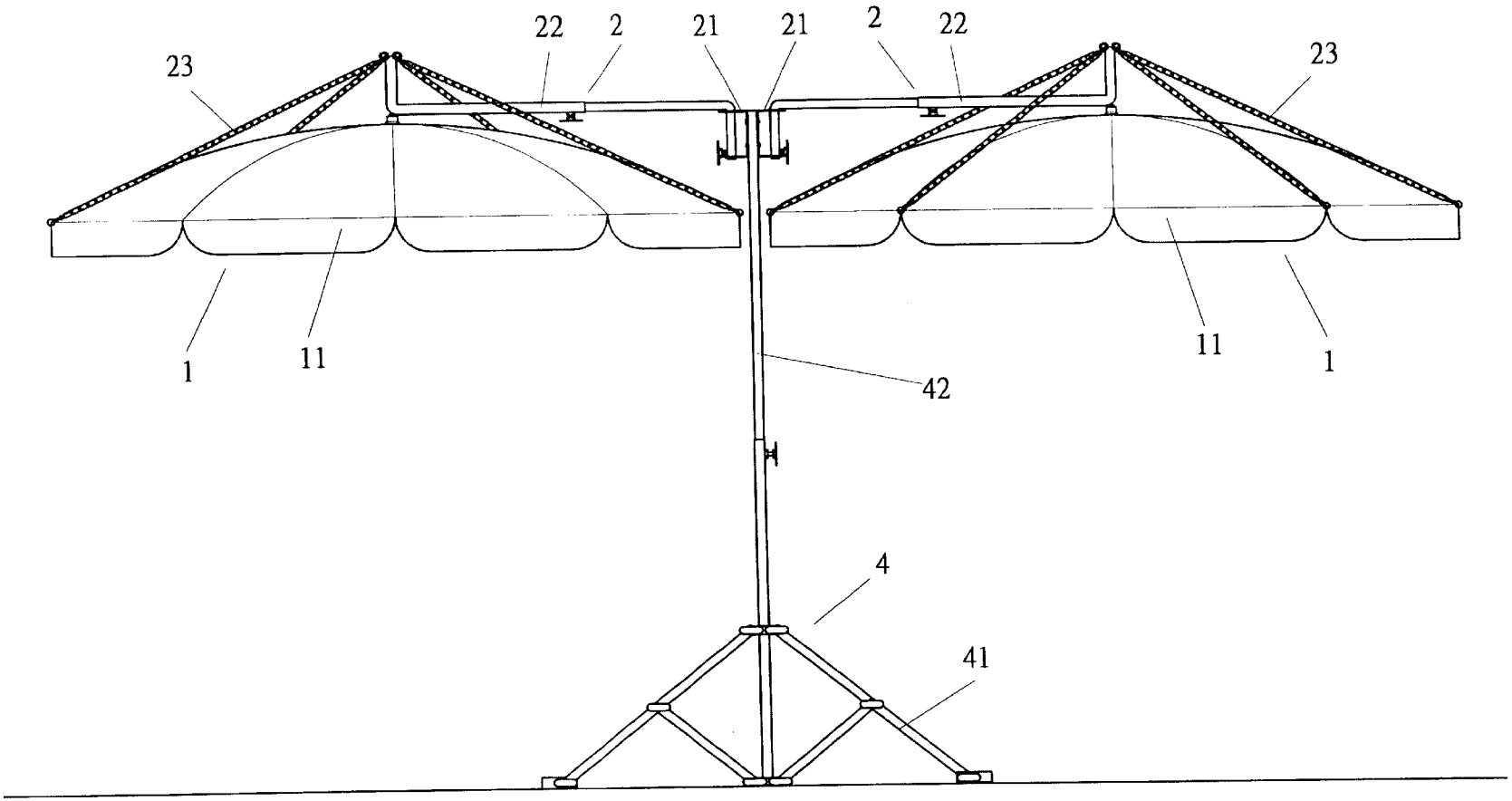
FIG. 7 is a schematic side view illustrating a modified embodiment of the stand for supporting two sunshade assemblies in accordance with the present invention.
Figure 8:
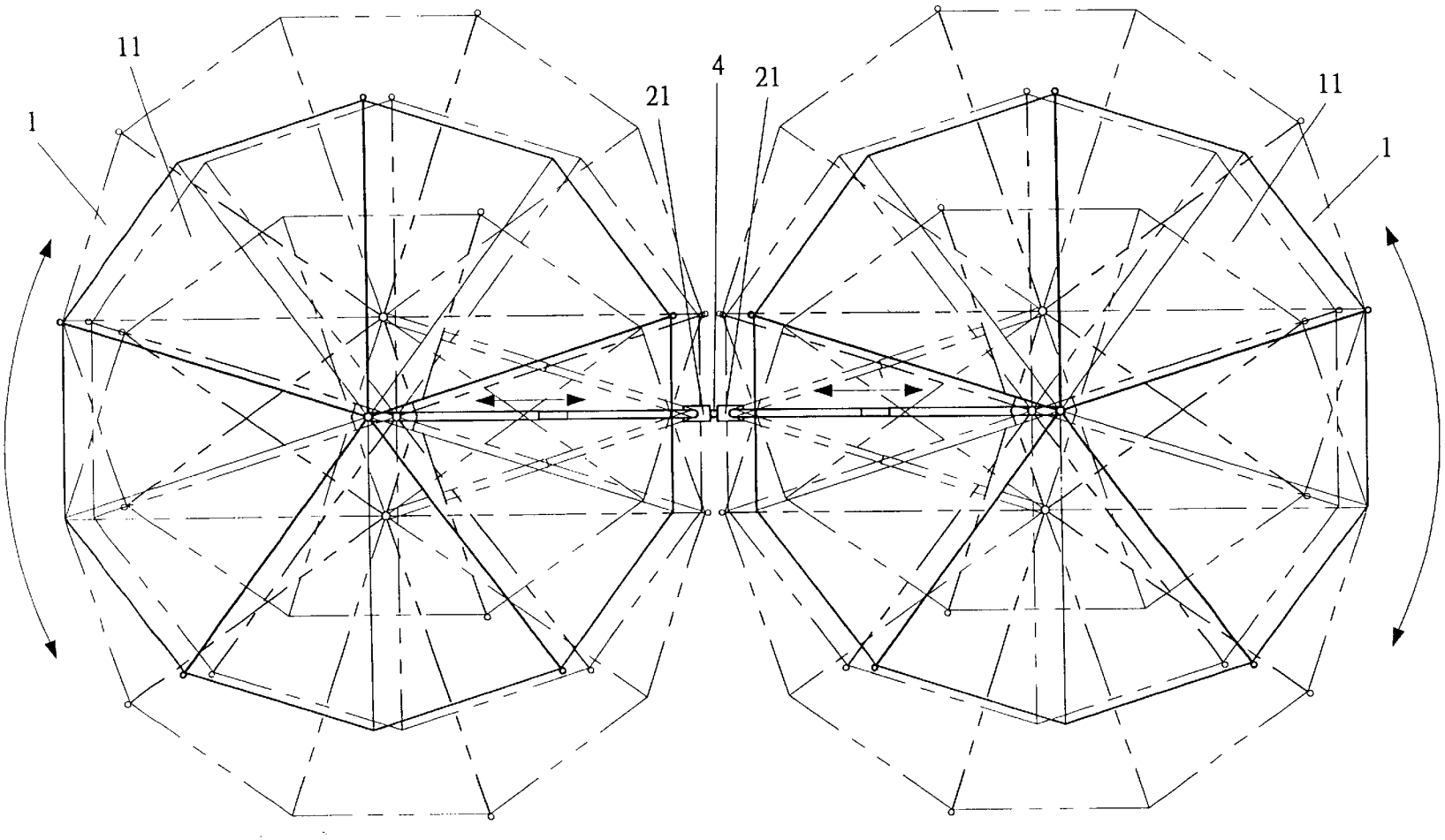
FIG. 8 is a top view illustrating adjustment in the positions of the adjustable sunshade assemblies in FIG. 7.
Figure 9:
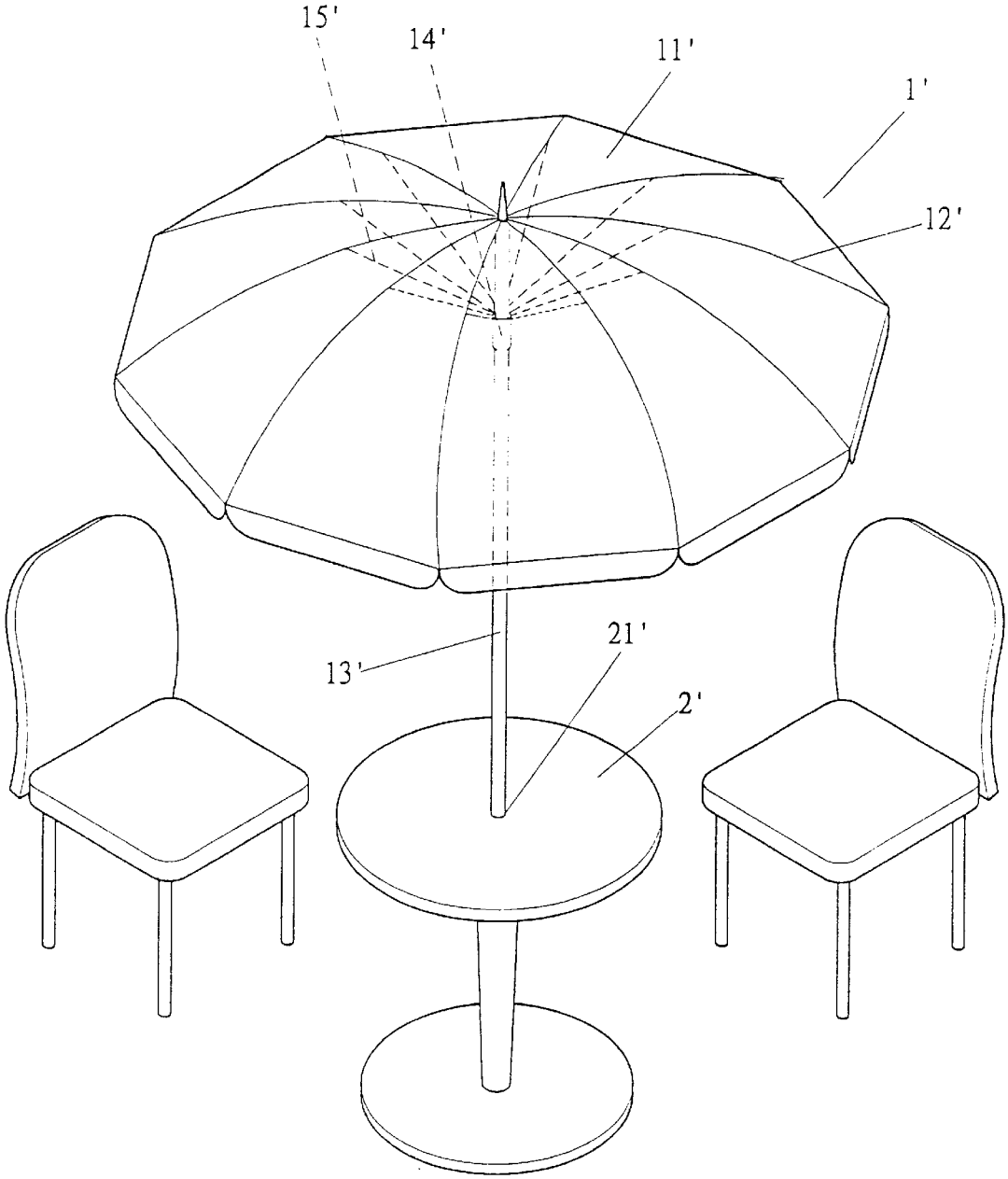
FIG. 9 is a perspective view of a conventional sunshade.
Figure 10:
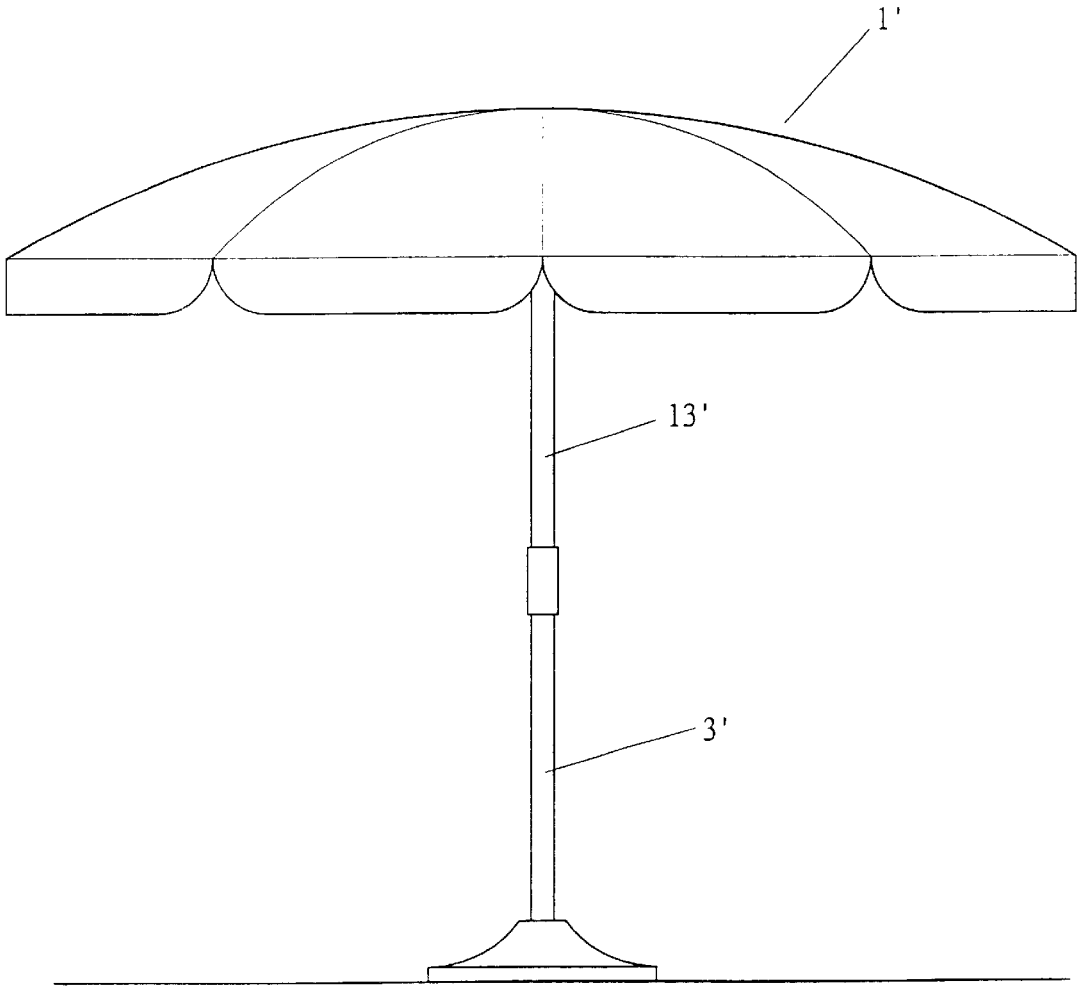
FIG. 10 is a side view illustrating another use of the conventional sunshade.

FIG. 5 illustrates a stand for supporting the sunshade assembly in accordance with the present invention. FIG. 6 illustrates the stand and the sunshade assembly. The stand 4 includes a plurality of legs 41 and a height-adjustable rod 42 to which the seat 214 of the connecting means 2 is securely attached. FIG. 7 illustrates a modified embodiment of the stand for supporting two identical sunshade assemblies in accordance with the present invention. FIG. 8 is a top view illustrating adjustment in the positions of the adjustable sunshade assemblies in FIG. 7.

According to the above description, it is appreciated that the sunshade assembly in accordance with the present invention includes the following advantages:

1. A larger space below the canopy 11 is provided, and the view for the users is better.
2. The main frame 1 is supported by chains 23 and is thus stabler.
3. The bulb 3 is directly mounted below the shaft 13 and the wires 31 for the bulb 3 are inside the shaft 13 to thereby provide an aesthetically pleasing effect.
4. The chains 23 bend when the main frame 1 is subjected to strong wing and thus shifts, thereby providing the main frame 1 with improved support.
5. The connecting means 2 can be adjusted in length and position according to need.
6. The sunshade assembly can be used with a stand 4. In addition, more than one sunshade assembly can be used with a common stand 4.

The chains 23 can be replaced by ropes or other bendable elements. In addition, the upper end of the shaft 13 can be engaged with the connecting tube 22 by other suitable means.

Although the invention has been explained in relation to its preferred embodiment, it is to be understood that many other possible modifications and variations can be made without departing from the scope of the invention as hereinafter claimed.

What is claimed is:

1. A sunshade assembly comprising:

a main frame including a shaft, a runner disposed on the shaft, a plurality of ribs each having a first end coupled to the shaft, a plurality of stretchers respectively coupled between the runner and the plurality of ribs, and a canopy overlaying the plurality of ribs, at least a pair of the plurality of ribs having a ring coupled to a second end thereof; and, connecting means for securely attaching the main frame to a support, the connecting means including:

a seat secured to the support, a connecting tube having a first end pivotally connected to the seat, the connecting tube being adjustable in an overall length thereof and having a second end engaged to an upper end of the shaft of the main frame, and a plurality of chains each having an upper end connected to the second end of the connecting tube and a lower end connected to the ring on a respective one of the ribs.

2. The sunshade assembly as claimed in claim 1, wherein the seat is U-shaped having an upper side, an intermediate side, and a lower side, the intermediate side of the seat being secured to the support, the upper side and the lower side of the seat having aligned pivot holes formed therein for pivotally receiving the first end of the connecting tube therein.

3. The sunshade assembly as claimed in claim 2, wherein the second end of the connecting tube is a vertical tube section having an upper end to which the upper ends of the chains are attached, the vertical tube section further having a lower end for engaging with the upper end of the shaft.

4. The sunshade assembly as claimed in claim 3, wherein the lower end of the vertical tube section includes a hole, the upper end of the shaft includes an engaging portion extended into the hole of the vertical tube section.

5. The sunshade assembly as claimed in claim 3, wherein the shaft includes a lower end, further comprising a bulb mounted in the lower end of the shaft.

6. The sunshade assembly as claimed in claim 5, further comprising wires for the bulb that are inserted into the shaft.

* * * * *